US008592725B1

(12) United States Patent
Hunger et al.

(10) Patent No.: US 8,592,725 B1
(45) Date of Patent: Nov. 26, 2013

(54) TAPED SEALED HEATING SYSTEM FOR LOW VOLTAGE HEATED GARMENTS

(71) Applicant: H2C Brands, LLC, Atlantic Beach, FL (US)

(72) Inventors: Robert L. Hunger, Atlantic Beach, FL (US); Christopher Haffly, Olympia, WA (US)

(73) Assignee: H2C Brands, LLC, Atlantic Beach, FL (US)

( * ) Notice: Subject to any disclaimer, the term of this patent is extended or adjusted under 35 U.S.C. 154(b) by 0 days.

(21) Appl. No.: 13/678,766

(22) Filed: Nov. 16, 2012

(51) Int. Cl.
*H05B 1/00* (2006.01)

(52) U.S. Cl.
USPC ..... 219/211

(58) Field of Classification Search
USPC ..... 219/50, 200, 201, 211, 212, 520, 528, 219/529, 535, 538, 542, 544, 546, 548, 219/549; 257/E21.001, E21.002, E23.001, 257/E23.01, E23.023, E23.031, E23.037, 257/E23.039
See application file for complete search history.

(56) References Cited

U.S. PATENT DOCUMENTS

| | | | | |
|---|---|---|---|---|
| 6,415,501 | B1 * | 7/2002 | Schlesselman et al. | 29/611 |
| 2005/0095406 | A1 * | 5/2005 | Gunzel et al. | 428/190 |
| 2008/0283513 | A1 * | 11/2008 | Ferguson et al. | 219/217 |

* cited by examiner

*Primary Examiner* — Tu B Hoang
*Assistant Examiner* — Joseph Iskra
(74) *Attorney, Agent, or Firm* — Mark Young, PA

(57) ABSTRACT

A taped sealed heating system for low voltage heated garments includes at least one heating pad connected by a bus to a power supply. The heating pad and bus are laminates comprised of a tape with a thermoplastic hot melt adhesive that encapsulates heating wires and adhere to textiles. A reticulate pattern of resistance wire is attached to a substrate disposed between the core shell and an outer layer of the heating element. By heat-pressing the sealing tape on the wire pattern stitched onto a substrate, the adhesive layer melts, covers the wires and substrate, cools to become solid, and firmly encases the wires. The heating pad and bus are affixed to the garment using sealing tape with a hot melt adhesive along the periphery of the pad and bus.

20 Claims, 3 Drawing Sheets

TAPED SEALED HEATING SYSTEM FOR LOW VOLTAGE HEATED GARMENTS

FIELD OF THE INVENTION

This invention relates generally to heated garments, and, more particularly, to a taped sealed heating system for low voltage heated garments.

BACKGROUND

Conventional, electrically heated garments require an inner lining. The lining hides the lead wires between heating pads and acts as a substrate to attach the heating pads. A problem with using an inner lining as a substrate is that it adds another layer of fabric between the heating panel and the user which impedes efficient transfer of heat. It also increases weight, bulk and bunching by having another layer of fabric. Additionally, liners conceal attractive comfortable shell material (e.g., fleece) that a wearer may prefer over the liner.

In conventional electrically heated garments, the lead wires are insulated and float loosely behind the internal liner layer. This means that the wires are not attached to the liner or the garment and are free to move between the liner and garment. Such movability has been known to cause durability and safety problems. Problems such as wire twisting and fatigue, stress on connections, and wire positioning, may increase wire resistance, reduce overall operating efficiency, or cause a short circuit or a break in a circuit that results in failure of the system.

What is needed is an electric heating element for garments that avoids floating wires, avoids the necessity of a liner, and produces a durable, flexible, and thermally efficient element that encapsulates the wires and becomes integrated with the shell fabric. The invention is directed to overcoming one or more of the problems and solving one or more of the needs as set forth above.

SUMMARY OF THE INVENTION

To solve one or more of the problems set forth above, in an exemplary implementation of the invention, a taped sealed heating system for low voltage heated garments includes at least one heating pads connected by a bus to a power supply. The heating pad and bus are laminates comprised of a thermoplastic material that adhere to textiles when heated. The bus contains lead wires disposed between the core shell and outer layer of the bus. A reticulate pattern of resistance wire stitched onto a substrate is disposed between the core shell and the outer layer of the heating pad.

A heating element, also referred to as a heating pad, for a garment according to principles of the invention includes a filament of uninsulated metal wire stitched onto a flexible fabric substrate into a pattern; a sealing tape that includes a sealing base film and a sealing hot melt adhesive coextensive with and affixed to the base film. The sealing tape is coextensive with the fabric substrate. The sealing hot melt adhesive coats the wire stitched onto the flexible fabric substrate. An insulation layer is coextensive with the flexible fabric substrate. The flexible fabric substrate is disposed between the sealing tape and the insulation layer. The insulation layer defines a stratum (layer) to abut the shell at the interior of the garment (i.e., the side of the shell that contacts a wearer). The sealing tape, wire stitched onto the flexible substrate and the insulation makes up a multilayer assembly having a periphery. An elongated border tape has a longitudinal axis, a thickness and a width. A portion the width of the elongated border tape overlaps the periphery. Another portion of the width of the elongated border tape is provided for attachment to the shell at the interior of the garment. The elongated border tape includes an elongated base film and an elongated hot melt adhesive coextensive with and affixed to the elongated base film. The heating element and multilayer assembly may also include an outermost layer, such as a thin Nylon taffeta layer, abutting and coextensive with the sealing base film of the sealing tape. This outermost layer is heat transmissive, meaning it does not substantially thermally insulate the heating wire from the wearer. Rather, it allows heat energy to pass through to the wearer. The filament of uninsulated metal wire may be stainless steel, such as 40 to 12 gauge AWG stainless steel. The sealing hot melt adhesive is a polymer that retains heat.

In one embodiment, the filament is a metal yarn spun from a plurality of long metal fibers. The diameter of a single metal fiber in the metal yarn may be in a range of about 1 μm to 50 μm. The materials of the metal fiber should be corrosion-resistant. Examples include Ni—Cr alloy fibers and stainless steel fibers. A multi-strand stainless steel yarn comprised of a plurality (e.g., 4 strands) of stainless steel filaments is one nonlimiting example of a suitable stainless steel wire.

A plurality of such heating elements may be electrically connected (e.g., in parallel) to an electric supply bus. The electric supply bus includes a pair of lead wires that supply electric power from a power supply such as a battery to the heating elements. The lead wires of the bus may be coated with a sealing tape to prevent shifting and twisting of the lead wires relative to the shell.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
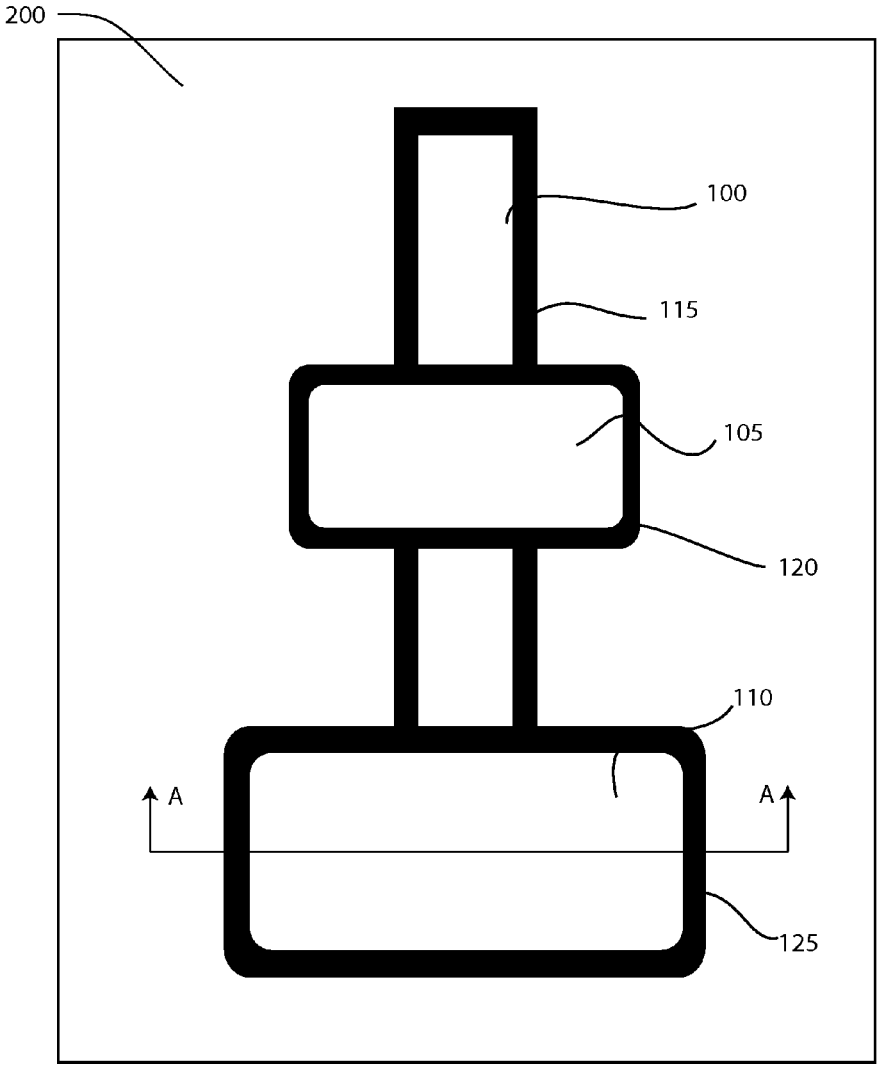
FIG. 1 is a top plan view of a taped sealed heating element affixed to a portion of a garment according to principles of the invention.

Referring to FIG. 1, a top plan view of a taped sealed heating element affixed to a portion of a garment according to principles of the invention is conceptually illustrated. The exemplary heating element includes two heating pads 105 and 110 connected by a bus 100. Each section, i.e., the bus 100, first heating element 105 and second heating element 110, are surrounded by a border tape 115, 120, 125. The border tape 115, 120, 125 affixes each section to the garment.

Figure 3:
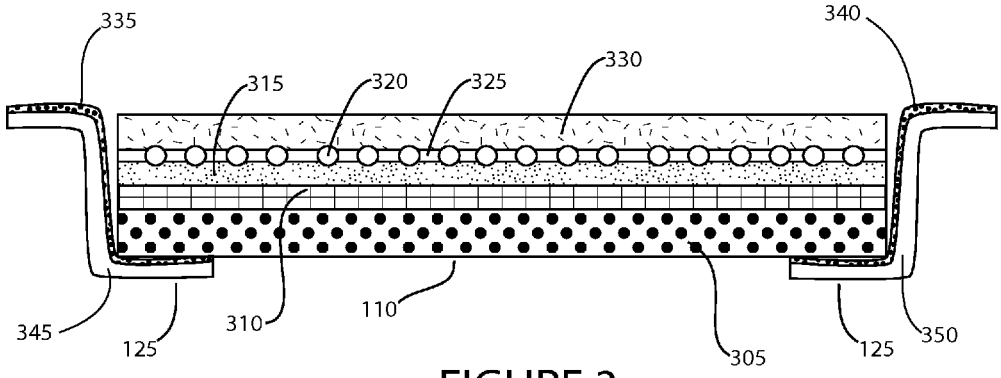
FIG. 3 is a section view of the taped sealed heating element before it is affixed to a garment according to principles of the invention.

The border tape 115, 120, 125 is a laminate that includes a base film 345, 350 (as shown in FIG. 3) and a hot melt adhesive 335, 340 that is suitable for use in garment construction. The material for the base film 345 preferably has a heat resistance (e.g., melting point) appreciably higher than the softening point (e.g., melting point) of the hot melt adhesive 335, 340. By heat-pressing the tape 115, 120, 125 on the periphery of a section of the heating element and on the shell fabric, the adhesive layer 335, 340 melts and bonds with the periphery and shell fabric. When the heat source is removed, the melted resin cools to become solid, so that the section of the heating element, shell fabric and the base film 345, 350 are firmly fixed to each other.

Nonlimiting examples of a base film 345, 350 include a polymer film such as a fluorine-containing resin, a polyurethane resin, a polyester resin such as polyethylene terephthalate or polybutylene terephthalate, an acrylic resin, a polyamide resin, a vinyl chloride resin, a synthetic rubber, a natural rubber, or a silicone resin. Additionally, the base film 345, 350 may optionally further contain a modifier such as a pigment, a plasticizer, an antioxidant, an ultraviolet absorber and/or a water repellant.

The thickness of the base film 345, 350 is not particularly important. A thickness of the base film 345, 350 50 μm or more facilitates handling at the time of production. A thickness 500 μm or less, improves flexibility of the base film 345, 350 and heat transfer through the base film 345, 350.

The adhesive used for the adhesive layer 335, 340 of the border tape 115, 120, 125 is not limited as long as it exhibits a bonding effect by attaching to the core shell of the garment and the periphery of the outer layer of the heating element during sealing treatment. A hot melt adhesive which is heat-melted by means of hot-air, ultrasound, high frequency waves and the like to exhibit adhesive strength is preferred. As the hot melt adhesive, various resins such as a polyethylene resin or a copolymer resin thereof, a polyamide resin, a polyester resin, a butyral resin, a polyacetic acid vinyl resin or a copolymer resin thereof, a cellulose derivative resin, a polymethyl methacrylate resin, a polyvinyl ether resin, a polyurethane resin, a polycarbonate resin, and a polyvinylchloride resin can be used alone or as a mixture of two or more kinds as desired.

The thickness of the hot melt adhesive layer 335, 340 is preferably 50 μm or more, more preferably 100 μm or more, and preferably 500 μm or less. If the hot melt adhesive layer is less than 50 μm, the volume of the resin is inadequate to completely bond to the core shell. On the other hand, if the hot melt adhesive layer 335, 340 has a thickness of more than 500 μm, it may take relatively long to sufficiently melt the hot melt adhesive when heat-pressing the sealing tape, thereby lowering productivity and risking thermal damage to the base film from the prolonged heating. If the duration of heat-pressing is decreased, the hot melt adhesive layer may not melt sufficiently for a high integrity seal.

The heating element is attached to a garment 200 or other object to be heated using the border tape 115, 120, 125. The border tape 115, 120, 125 overlays the free edge of the heating elements 105, 110 and bus 100, and the adjacent portions of the garment 200. By way of example and not limitation, the portions of the garment 200 may comprise part of the inside back panel shell of a coat, shirt or jacket. The invention is not limited to any particular number, size or shape of heating pads, so long as there is at least one that suitably fits the object to be heated and works with the available power supply and resistance wires.

Figure 2:
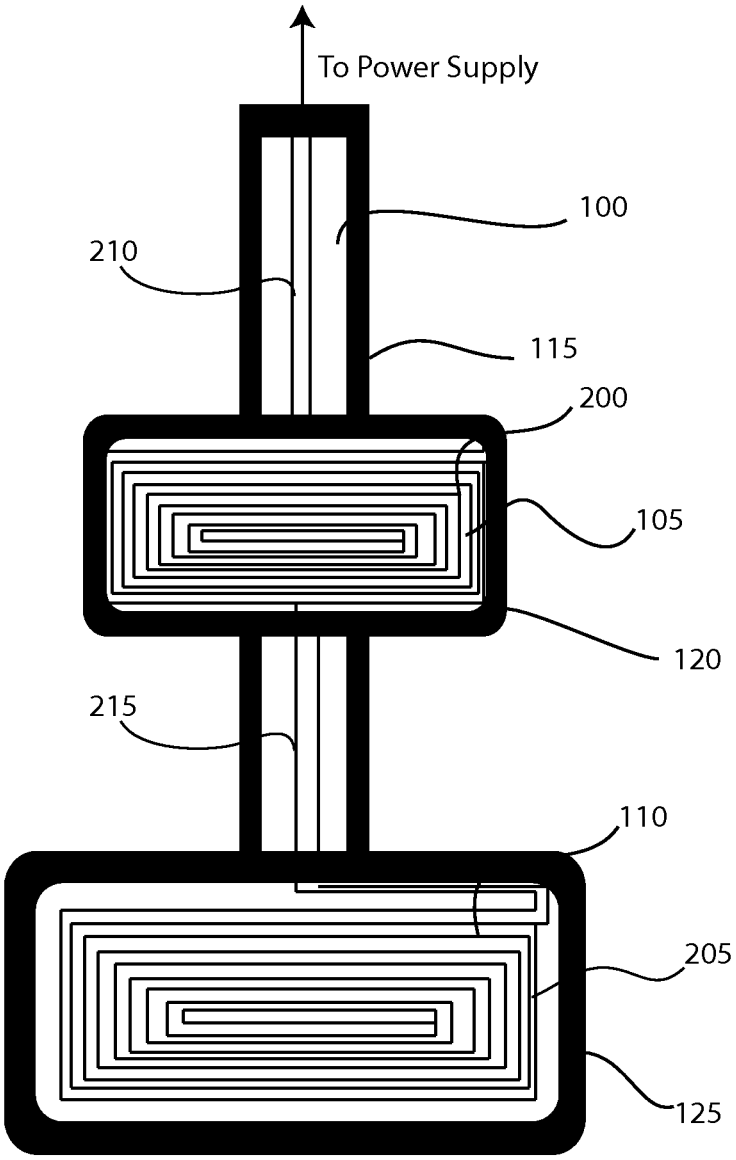
FIG. 2 is a bottom view of a the taped sealed heating element without the portion of the garment to which it is affixed according to principles of the invention.

Referring now to FIG. 2, a bottom view of the taped sealed heating element, without the portion of the garment to which it is affixed, according to principles of the invention is conceptually illustrated. To expose the wiring, an insulation layer, which is discussed below, is also omitted in FIG. 2. Each pad has one or more patterns of electric resistance wire 200, 205 stitched onto a substrate material by an embroidery machine. Preferably the wire 200, 205 is uninsulated stainless steel, nickel-copper, copper or other suitable resistance wire. On pads 105, 110, generally rectangular spiral loops of wire 200, 205 are shown. The invention is not limited to any particular arrangement or composition of electric resistance wire 200, 205. Any composition and arrangement suitable for resistive heating to safely and efficiently warm a person may be utilized. However, uninsulated stainless steel wire is preferred. Spiral and or zigzag patterns are preferred to lengthen the amount of wire in each pad and thereby distribute heat evenly.

Electric lead wires 210, 215, in the bus 100, connect each of the patterns of wire to a power supply for a complete circuit. To avoid galvanic corrosion, the lead wires 210, 215 may be comprised of the same material wire as the resistance wire 200, 205. The lead wires 210, 215 may be insulated with a rubber or plastic outer sheath. Each pattern of resistance wire 200, 205 may be connected in parallel across the lead wires 210, 215. In such a parallel circuit, the voltage across each pattern is the same and the total current is the sum of the currents through each pattern. This type of circuitry provides the advantage that if any single pattern of resistance wire is damaged or otherwise is incapable of providing heat, the remaining patterns will be fully operable. Lead wires may be connected to resistance wires by mechanical coupling, solder or other suitable conductive coupling.

A power supply, switch and optional temperature regulation circuitry are operably coupled to the lead wires 210, 215. The power supply may be a battery pack of rechargeable or disposable batteries. The switch may be an on-off switch or a voltage regulating switch. The temperature regulation circuitry may monitor time, actual temperature, or resistance as an analog of temperature, and regulate voltage or current to maintain the temperature in an acceptable range. As the power supply, switch and optional temperature regulation circuitry are external to the features comprising the invention, they are not illustrated in the Figures. The invention is not limited to any particular power supply, switch or optional temperature regulation circuitry.

Referring now to FIG. 3, a section view (Section A-A) of the taped sealed heating element before it is affixed to a garment according to principles of the invention is conceptually illustrated. The taped sealed heating element is a laminate comprised of an outer layer 305 which contacts the wearer, a base film 310 of tape, a hot melt adhesive layer 315 of the tape, resistance wires 320 stitched (e.g., embroidered) into a substrate fabric 325, and an insulation layer 330. The border tape (e.g., 120, 125), which is described above, also includes a base film 345, 350 and a hot melt adhesive 335, 340.

The outermost layer 305 that faces the wearer may be comprised of various materials or combinations of materials. For example, it may be comprised of nylon taffeta, such as 210T, 70D×70D, nylon taffeta. Other synthetic or natural fiber fabrics, knitted or woven, may also be used without departing from the scope of the invention. The outermost layer 305 should provide a durable yet comfortable covering. Preferably the material facilitates heat transfer from the encapsulated heating element. Thus, the outermost layer 305 should provide minimal, if any, thermal insulation. In a preferred embodiment, the outermost layer 305 does not substantially impede heat transfer from the wires 320.

A sealing tape is disposed between the resistance wire layer 320, 325 and the outer layer 305. In one exemplary embodiment, the sealing tape comprises a two-layer structure, including a base film 310 and an adhesive layer 315 on one side of the base film 310. The material for the base film 310 preferably has a heat resistance (e.g., melting point) appreciably higher than the softening point (e.g., melting point) of the hot melt adhesive 315. By heat-pressing the sealing tape on an area of a shell fabric, the adhesive layer 315 melts and fills the interstices between wires 320 and pores of the substrate 325. When the heat source is removed, the melted resin cools to become solid. When the hot melt adhesive solidifies, it coats and insulates the wires 320. Depending upon the volume of adhesive, it may encapsulate the wires. The adhesive also fills voids or pores in the substrate 325. The process results in a continuum of hot melt adhesive, with embedded wires, coextensive with the heating element. The adhesive also helps maintain distance between adjacent wire strands to prevent electrical shorts. The adhesive also fixes the wire strands 320 in position on the substrate 325, thereby preventing twisting and translation.

Nonlimiting examples of a base film 310 include polymer films, such as a fluorine-containing resin, a polyurethane resin, a polyester resin such as polyethylene terephthalate or polybutylene terephthalate, an acrylic resin, a polyamide resin, a vinyl chloride resin, a synthetic rubber, a natural rubber, or a silicone resin. Additionally, the base film 310 may optionally further contain a modifier such as a pigment, a plasticizer, an antioxidant, or an ultraviolet absorber. While water proof or repellant films are preferred, the invention is not so limited. Films other than water proof or repellant films may be utilized within the scope of the invention.

A thickness of the base film 310 is about 50 μm or more, more preferably 100 μm or more, and preferably 500 μm or less. By making the thickness of the base film 310 50 μm or more, handling at the time of production is improved, and by making the thickness 500 μm or less, the flexibility of the base film 310 can be ensured while ensuring structural and thermal integrity of the tape. The thickness of the base film 310 is an average thickness, which can be measured using a dial thickness gauge.

The adhesive used for the adhesive layer 315 is not particularly limited as long as, during sealing treatment, it exhibits a sealing effect by filling interstices between the wires 320 and the substrate 325 onto which the wires 320 are stitched. A hot melt adhesive 315 which is heat-melted by means of hot-air, ultrasound, high frequency waves and the like to exhibit adhesive strength is preferred. As the hot melt adhesive, various resins such as a polyethylene resin or a copolymer resin thereof, a polyamide resin, a polyester resin, a butyral resin, a polyacetic acid vinyl resin or a copolymer resin thereof, a cellulose derivative resin, a polymethyl methacrylate resin, a polyvinyl ether resin, a polyurethane resin, a polycarbonate resin, and a polyvinylchloride resin can be used alone or as a mixture of two or more kinds as desired.

The thickness of the hot melt adhesive layer 315 is preferably 50 μm or more, more preferably 100 μm or more, and preferably 500 μmor less. If the hot melt adhesive layer 315 is less than 50 μm, the volume of the resin is insufficient to fill the interstices between the wires 320 and in the substrate 325. On the other hand, if the hot melt adhesive layer 315 has a thickness of more than 500 μm, it may take too long to sufficiently melt the hot melt adhesive when heat-pressing the sealing tape, so that there are possibilities of lowering productivity and causing a thermal damage on the base film 310 to be bonded. If the time for heat-pressing is shortened, the hot melt adhesive layer may not be melted sufficiently so that a sufficient sealing effect cannot be obtained.

The resistance wire layer 320, 325 is comprised of resistance wire 320, embroidered or otherwise stitched or bonded to a substrate 325. The substrate 325 may comprise a woven fabric, knitted fabric, nonwoven fabric, netting and the like. The wire 320 is electrically conductive resistance wire that heats, through ohmic or resistive heating, when an electric current passes through the wires. The heat produced is proportional to the square of the current multiplied by the electrical resistance of the wire. The resistance of the wire is generally determined by two factors: geometry (shape) and materials, with a long, thin wire generally having higher resistance than a short, thick wire of the same material. Materials are important as well. The difference between, copper, aluminum, nickel and steel, for example, is related to their microscopic structure and electron configuration, and is quantified by a property called resistivity. In a preferred embodiment, thin (e.g., 40 to 12 gauge AWG, preferably 28 to 20 gauge) un-insulated stainless steel wire is used. Such wire is typically flexible yet durable enough to run through textile and embroidery machines. In another embodiment, a yarn comprised of multiples filaments of such conductive wire is used.

In one embodiment, the filament is a metal yarn spun from a plurality of long metal fibers. The diameter of a single metal fiber in the metal yarn may be in a range of about 1 μm to 50 μm. The materials of the metal fiber should be corrosion-resistant. Examples include Ni—Cr alloy fibers and stainless steel fibers. A multi-strand stainless steel yarn comprised of a plurality (e.g., four strands) of stainless steel filaments is one nonlimiting example of a suitable stainless steel wire.

The wire is stitched to the substrate 325 with a computerized embroidery machine using patterns digitized with embroidery software to form an electric resistance heating/warming element which is very flexible and stable, and can be jostled and bent and without adversely affecting the electrical circuit. The substrate 325 provides a durable foundation for supporting the pattern of stitched wire. The pattern features of the electric resistance heating/warming element are sized and shaped to conform to regions of an article to be heated.

The insulation layer 330 is disposed between the shell of the garment and the resistance wire layer 320. The insulation layer 330 limits heat generated from the resistance wires from escaping through the shell. Nonlimiting examples of material for an insulation layer include wool, cotton, polyester, and foam (e.g., Neoprene®).

During use, the wires 320 experience ohmic heating when energized by an electric current. The temperature of the heated wires is insufficient to melt the hot melt adhesive, yet hot enough to transfer heat to the wearer. Concomitantly, the tape 310, 315 in combination with the outer layer 305 and insulation layer 330 acts as a heat sink that distributes and transfers thermal energy from the heated wires to the wearer. The continuum of hot melt adhesive over the wires facilitates distribution of heat over the entire area of the heating pad. In contrast, wires of a conventional garment heating element are separated by air space, which impedes distribution of heat. The heat sink effect provides retained thermal energy long after electric power to the heating element is discontinued. The heating element, as a heat sink, remains warm for considerable time after power to the heating element ceases.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A heating element for a garment, said garment comprising a shell having an interior and an exterior, said interior being contacted by a wearer when the garment is worn, said heating element comprising:

a filament of uninsulated metal wire stitched onto a flexible fabric substrate into a pattern, said pattern comprising a plurality of spaced apart segments, with spaces therebetween, and a plurality of bends between the plurality of straight segments; and a sealing tape sheet comprising a sealing base film and a sealing hot melt adhesive coextensive with and affixed to the base film, said sealing tape sheet being coextensive with said fabric substrate, said sealing hot melt adhesive coating the filament of uninsulated metal wire stitched onto the flexible fabric substrate and occupying spaces between the plurality of spaced apart segments by flowing into said spaces when said hot melt adhesive is melted and said hot melt adhesive solidifying in said spaces when cooled, said hot melt adhesive preventing contact between the plurality of spaced apart segments of the filament of uninsulated metal wire, thereby preventing electrical shorts, and said sealing hot melt adhesive having a thickness effective for coating the filament of uninsulated metal wire stitched onto the flexible fabric substrate and occupying spaces between the plurality of spaced apart segments by flowing into said spaces when said hot melt adhesive is melted and said hot melt adhesive solidifying in said spaces when cooled; and a garment thermal insulation layer coextensive with the flexible fabric substrate, said flexible fabric substrate being disposed between the sealing tape and the garment thermal insulation layer, said garment thermal insulation layer defining a stratum to abut the shell at the interior of the garment; and said sealing tape sheet, uninsulated metal wire stitched onto the flexible substrate in the pattern, and the garment thermal insulation comprising a flexible multilayer assembly having a periphery; and an elongated border tape having a longitudinal axis, a thickness and a width, a portion the width of the elongated border tape overlapping the periphery, and another portion of the width of the elongated border tape being provided for attachment to the shell at the interior of the garment, said elongated border tape comprising an elongated base film and an elongated hot melt adhesive coextensive with and affixed to the elongated base film, said elongated hot melt adhesive of the elongated border coating the periphery of the multilayer assembly and said elongated base film of the elongated border sealing the periphery of the multilayer assembly.

2. The heating element for a garment according to claim 1, further comprising an outermost layer abutting and coextensive with the sealing base film of the sealing tape, said outermost layer comprising a heat transmissive material, and said multilayer assembly further comprising said outermost layer.

3. The heating element for a garment according to claim 2, said filament of uninsulated metal wire comprising stainless steel.

4. The heating element for a garment according to claim 3, said filament of uninsulated metal wire comprising a yarn, said yarn comprising a plurality of strands of uninsulated stainless steel wire.

5. The heating element for a garment according to claim 3, said outermost layer comprising nylon taffeta.

6. The heating element for a garment according to claim 3, said outermost layer comprising 210T nylon taffeta.

7. The heating element for a garment according to claim 1, said sealing hot melt adhesive coating the wire stitched onto the flexible fabric substrate forming a continuum of sealing hot melt adhesive coextensive with the flexible fabric substrate.

8. The heating element for a garment according to claim 7, said sealing hot melt adhesive comprising a polymer that retains heat.

9. The heating element for a garment according to claim 8, said sealing hot melt adhesive having an average thickness of about 50 μm to 500 μm.

10. The heating element for a garment according to claim 8, said sealing base film having an average thickness of about 50 μm to 500 μm.

11. A heating system for a garment, said garment comprising a shell having an interior and an exterior, said interior being contacted by a wearer when the garment is worn, said heating system comprising a plurality of heating elements electrically connected to an electric power supply bus, each heating element comprising:

a filament of uninsulated metal wire stitched onto a flexible fabric substrate into a pattern, said pattern comprising a plurality of spaced apart segments, with spaces therebetween, and a plurality of bends between the plurality of straight segments; and a sealing tape sheet comprising a sealing base film and a sealing hot melt adhesive coextensive with and affixed to the base film, said sealing tape sheet being coextensive with said fabric substrate, said sealing hot melt adhesive coating the filament of uninsulated metal wire stitched onto the flexible fabric substrate and occupying spaces between the plurality of spaced apart segments by flowing into said spaces when said hot melt adhesive is melted and said hot melt adhesive solidifying in said spaces when cooled, said hot melt adhesive preventing contact between the plurality of spaced apart segments of the filament of uninsulated metal wire, thereby preventing electrical shorts, and said sealing hot melt adhesive having a thickness effective for coating the filament of uninsulated metal wire stitched onto the flexible fabric substrate and occupying spaces between the plurality of spaced apart segments by flowing into said spaces when said hot melt adhesive is melted and said hot melt adhesive solidifying in said spaces when cooled; and a garment thermal insulation layer coextensive with the flexible fabric substrate, said flexible fabric substrate being disposed between the sealing tape and the garment thermal insulation layer, said garment thermal insulation layer defining a stratum to abut the shell at the interior of the garment; and said sealing tape sheet, uninsulated metal wire stitched onto the flexible substrate in the pattern, and the garment thermal insulation comprising a flexible multilayer assembly having a periphery; and an elongated border tape having longitudinal axis, a thickness and a width, a portion the width of the elongated border tape overlapping the periphery, and another portion of the width of the elongated border tape being provided for attachment to the shell at the interior of the garment, said elongated border tape comprising an elongated base film and an elongated hot melt adhesive coextensive with and affixed to the elongated base film, said elongated hot melt adhesive of the elongated border coating the periphery of the multilayer assembly and said elongated base film of the elongated border sealing the periphery of the multilayer assembly; and the electric supply bus comprising a pair of conductive wire leads electrically coupled to each heating element and electrically coupled to an electric power supply.

12. The heating system for a garment according to claim 11, said electric power supply comprising a battery.

13. The heating system for a garment according to claim 11, said electric supply bus further comprising a bus sealing tape comprising a sealing base film and a bus sealing hot melt adhesive coextensive with and affixed to the base film, said bus sealing hot melt adhesive covering the pair of conductive wire leads.

14. The heating system for a garment according to claim 13, each heating element further comprising an outermost layer abutting and coextensive with the sealing base film of the sealing tape, said outermost layer comprising a heat transmissive material, and said multilayer assembly further comprising said outermost layer.

15. The heating system for a garment according to claim 14, said filament of uninsulated metal wire in each heating element comprising stainless steel.

16. The heating system for a garment according to claim 15, said outermost layer in each heating element comprising nylon taffeta.

17. The heating system for a garment according to claim 15, said outermost layer in each heating element comprising 210T nylon taffeta.

18. The heating system for a garment according to claim 16, said sealing hot melt adhesive coating the wire stitched onto the flexible fabric substrate in each heating element forming a continuum of sealing hot melt adhesive coextensive with the flexible fabric substrate.

19. The heating system for a garment according to claim 18, said sealing hot melt in each heating element adhesive having an average thickness of about 50 μm to 500 μm.

20. The heating system for a garment according to claim 19, said sealing base film in each heating element having an average thickness of about 50 μm to 500 μm.

* * * * *

UNITED STATES PATENT AND TRADEMARK OFFICE

CERTIFICATE OF CORRECTION

PATENT NO. : 8,592,725 B1
APPLICATION NO. : 13/678766
DATED : November 26, 2013
INVENTOR(S) : Robert L. Hunter and Christopher Haffly It is certified that error appears in the above-identified patent and that said Letters Patent is hereby corrected as shown below:

Title Page, Item (12) "Hunger et al." should read --Hunter et al.--.

Title Page, Item (72), the surname "Hunger" of the first named inventor is replaced with --Hunter--.

Signed and Sealed this
First Day of July, 2014

Michelle K. Lee

Michelle K. Lee
*Deputy Director of the United States Patent and Trademark Office*